US006162045A

United States Patent [19]

Hazard

[11] Patent Number: 6,162,045

[45] Date of Patent: Dec. 19, 2000

[54] WAVE FLAME CONTROL

[75] Inventor: Gary M. Hazard, Morrisville, Vt.

[73] Assignee: Superior Fireplace Company, Fullerton, Calif.

[21] Appl. No.: 09/200,222

[22] Filed: Nov. 25, 1998

Related U.S. Application Data

[60] Provisional application No. 60/066,566, Nov. 26, 1997.

[51] Int. Cl.[7] ..... F23C 11/04; F23Q 2/32

[52] U.S. Cl. ..... 431/1; 431/12; 431/125; 431/354; 126/512; 366/127

[58] Field of Search ..... 431/1, 125, 12, 431/354; 126/512, 503; 181/206; 381/165, 337, 338, 397; 62/6; 310/15

[56] References Cited

U.S. PATENT DOCUMENTS

| | | | |
|---|---|---|---|
| 2,949,166 | 8/1960 | Coleman et al. | 318/114 |
| 3,156,292 | 11/1964 | Ross | 431/354 |
| 3,501,098 | 3/1970 | Evans | 431/354 |
| 3,723,046 | 3/1973 | Poling et al. | 431/18 |
| 3,882,732 | 5/1975 | Fletcher et al. | 73/505 |
| 4,118,175 | 10/1978 | Riehl | 431/354 |
| 4,139,806 | 2/1979 | Kanber et al. | 60/721 |
| 4,307,964 | 12/1981 | Dudgeon et al. | 366/127 |
| 4,359,962 | 11/1982 | Olsson et al. | 181/0.5 |
| 4,393,708 | 7/1983 | Barmatz et al. | 60/721 |
| 4,418,456 | 12/1983 | Riehl | 431/354 |
| 4,592,292 | 6/1986 | Olsson et al. | 431/1 |
| 4,635,571 | 1/1987 | Olsson et al. | 431/1 |
| 4,674,973 | 6/1987 | Wright | 431/354 |
| 4,699,588 | 10/1987 | Zinn et al. | 431/1 |
| 4,915,616 | 4/1990 | Kanamaru et al. | 431/126 |
| 5,231,337 | 7/1993 | Van Namen | 318/128 |
| 5,302,111 | 4/1994 | Jouvaud et al. | 431/1 |
| 5,319,938 | 6/1994 | Lucas | 62/6 |
| 5,445,517 | 8/1995 | Kondou et al. | 431/1 |
| 5,456,594 | 10/1995 | Yap | 431/1 |
| 5,575,144 | 11/1996 | Brough | 60/39.02 |
| 5,579,399 | 11/1996 | Lucas | 381/165 |
| 5,645,409 | 7/1997 | Ni et al. | 431/125 |
| 5,655,513 | 8/1997 | Whitfield | 126/512 |
| 5,746,588 | 5/1998 | Binzer | 431/354 |
| 5,809,769 | 9/1998 | Richards et al. | 60/39.06 |
| 5,890,485 | 4/1999 | Shimek et al. | 126/512 |
| 5,892,293 | 4/1999 | Lucas | 431/1 |
| 5,938,421 | 8/1999 | George, II | 431/1 |

FOREIGN PATENT DOCUMENTS

| | | | |
|---|---|---|---|
| 406058123 | 3/1994 | Japan | 181/206 |
| 895574 | 4/1996 | Japan | 181/206 |

*Primary Examiner*—Ira S. Lazarus
*Assistant Examiner*—David Lee
*Attorney, Agent, or Firm*—Christie, Parker & Hale, LLP

[57] ABSTRACT

A burner system is provided which creates standing waves in the gas/air flow within the burner so as to vary the pressure distribution along the length of the burner and thus the heights of the flames produced along the length of the burner. By changing the standing waves, the pressure distributions within the burner are changed, thereby causing the burner to produce changing flame patterns that simulate realistic wood burning flame patterns. In another embodiment, two orthogonal or sinusoidal gas/air flows offset by a phase angle are generated within the burner creating a beat frequency. By varying the phase angle offset, the rate of occurrence of the beats defining the beat frequency are varied resulting in the variation of the pressure distribution within the burner. Consequently, the flame patterns generated by the burner are varied simulating the appearance of realistic wood burning flame patterns.

26 Claims, 7 Drawing Sheets

WAVE FLAME CONTROL

CROSS-REFERENCE TO RELATED APPLICATION

This application claims priority and is based upon U.S. Provisional Patent Application No. 60/066,566 filed on Nov. 26, 1997 which is fully incorporated herein by reference.

BACKGROUND OF THE INVENTION

Many decorative gas appliances in the hearth industry are designed around the burner and ceramic log concept. The draw back with many such appliances is that they do not create realistic flame patterns. As such, there is a need for a burner system which can be incorporated in a gas appliance for producing realistic wood burning flame patterns.

SUMMARY OF THE INVENTION

A first embodiment of the present invention is directed to a burner system which produces realistic looking flame patterns by generating standing pressure waves in the gas/air flow inside a burner. A burner is used having a first and a second end. A gas inlet penetrates the first end. The inner surfaces of both ends are blunt in order to ensure that the created pressure waves will be reflected. An opening is formed on a side of the burner for the intake of air. A transducer such as a speaker in line to the air opening is used to create disturbances that generate standing pressure waves within the burner. Once a standing pressure wave is created within the burner, the pressure distribution along the length of the burner will approximate the amplitude distribution of the standing wave along the length of the burner. As a result, the heights of flames, which are proportional to the pressure of the gas/air mixture, are varied along the burner length. By changing the pressure standing wave generated within the burner, the flame pattern created by the burner will be varied due to the change in the pressure distribution of the gas/air mixture flowing in the burner. A standing wave generated within burner can be changed by controlling the speaker or transducer output.

In the second embodiment, a burner is used having two gas inlets. The gas flow through each inlet is controlled by an electromechanical valve, each driven by a sinusoidal electric signal. One valve opens and closes to meter the flow volume according to the function cos ($\omega t$). The other valve opens and closes to meter the flow volume according to the function cos ($\omega\alpha$)t. Thus, the volume of gas/air mixture going to each input of the burner varies in a sinusoidal fashion, where, $\alpha$ is the phase angle difference between the sinusoidal flows, and $\omega$ is the frequency of the sinusoid defining each flow. These two sinusoidal flows create a flow with nearly the same frequency, $\omega$, and an additional beat frequency which is said to throb or beat. This embodiment can also be practiced by metering each flow according to orthogonal functions such that the flow to the first inlet is also offset from the flow to the second inlet by a phase angle $\alpha$.

The rate of occurrence of the beats defining the beat frequency can be controlled electronically by varying $\alpha$. As $\alpha$ goes to zero, the beat frequency becomes lower and lower. When $\alpha$ becomes larger, the beat frequency increases until it is no longer perceptible. As a result, by varying $\alpha$, the pressure waves generated inside the burner are varied. Each pressure wave generated defines a non-constant gas/air pressure distribution in the burner. Consequently, the heights of the flames generated along the burner are not constant. As a result, the changing of pressure waves in the burner results in a variance of the flame patterns simulating realistic wood burning flame patterns.

DETAILED DESCRIPTION OF THE INVENTION

The first embodiment of the present invention is directed to a burner system which produces realistic looking flame patterns by generating standing pressure waves in the gas/air flow inside a burner. It should be noted that while the present invention is described in terms of a gas burner, the invention also applies to other types of fuel burners. Thus, the term "gas" as used herein should not be interpreted to preclude other fuels.

In a first embodiment, realistic flame patterns are created by producing standing pressure waves in the gas/air mixture flowing inside the burner. A discussion on standing wave characteristics is provided in pages 129–132 of Roeder, *The Physics and Psychophysics of Music* (1995) which are incorporated herein by reference. Also incorporated herein by reference is the ASTM standard C384-95 which describes a method for generating standing waves in a tubular structure referred to as an "Impedance Tube."

A burner tube, whether straight or curved, is a resonant cavity. The gas/air molecules may be made to vibrate back and forth at specific frequencies such that standing waves exist inside the burner tube. The frequencies of vibration required to produce a standing wave are the resonant frequency and the harmonics of the burner. These frequencies are dictated by the velocity of sound within the gas/air medium flowing inside the burner and the geometry of the burner.

Figure 1:
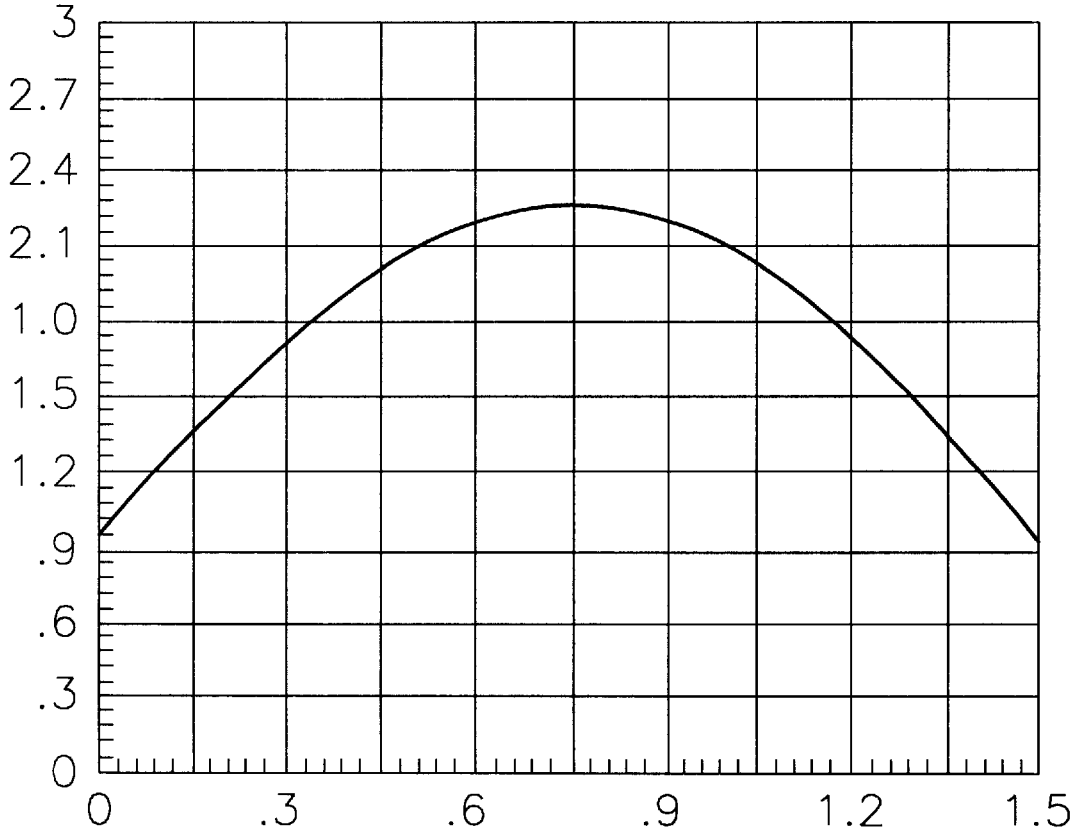
FIGS. 1 and 2 depict exemplary standing waves formed along the length of a burner tube.
Figure 2:
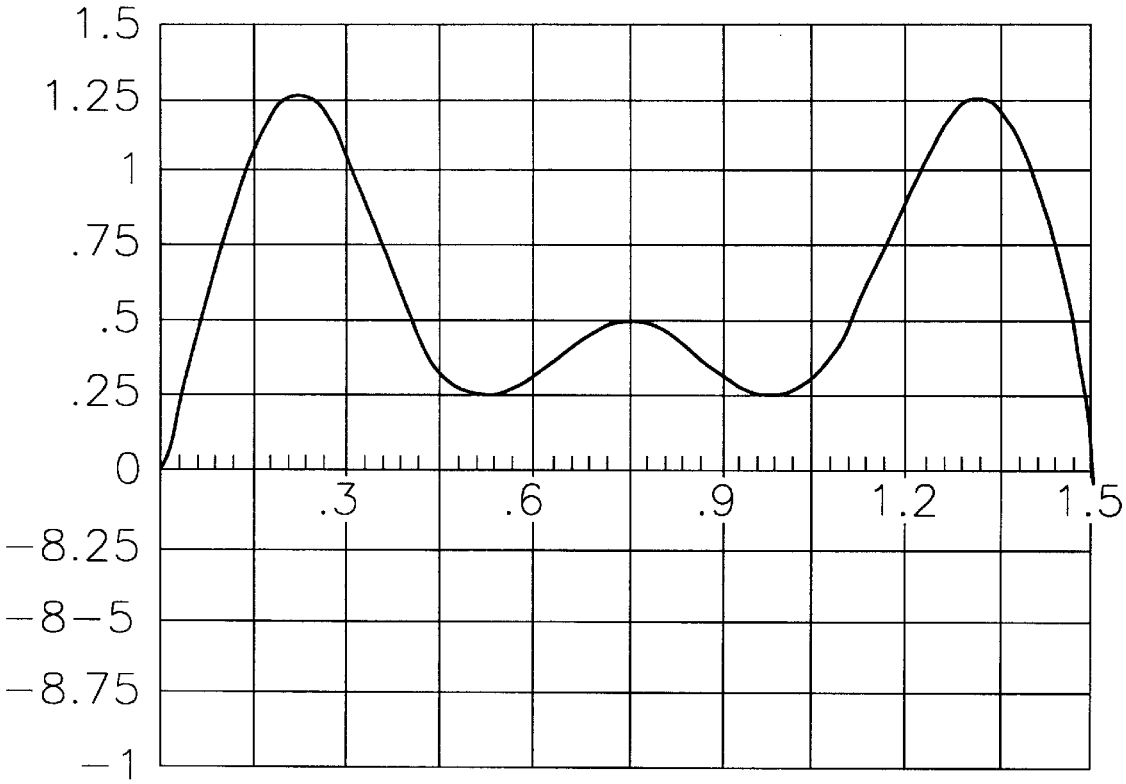

Standing waves create variations in pressure along their length. As such, standing waves create a pressure distribution along the length of the burner. The pressure distributions approximate the amplitude distribution of the wave along the length of the burner tube. Exemplary standing wave amplitude (or pressure) distributions along the burner length are depicted in FIGS. 1 and 2. The height of a flame is proportional to the pressure of the gas/air mixture at the location along the burner where it is generated. As a result of the pressure distributions created by the standing waves within the burner, the heights of flames generated by burning the gas/air mixture flowing through the burner are varied along the length of the burner. As such, each flame pattern produced is a function of the pressure distribution created by the standing wave and may be influenced by the geometry characteristics of the burner ports.

By varying the standing waves produced within a burner, flame patterns can be produced that are not static for a given firebox, burner tube and port configuration. The flame patterns created by this system are very dynamic, changing in seconds from one flame picture to a completely different flame picture.

Figure 3B:
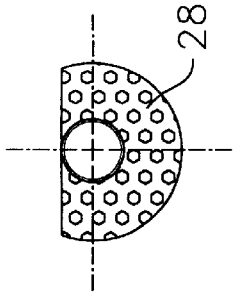
FIG. 3B is a transverse cross-sectional view of the burner tube shown in FIG. 3A.
Figure 3A:
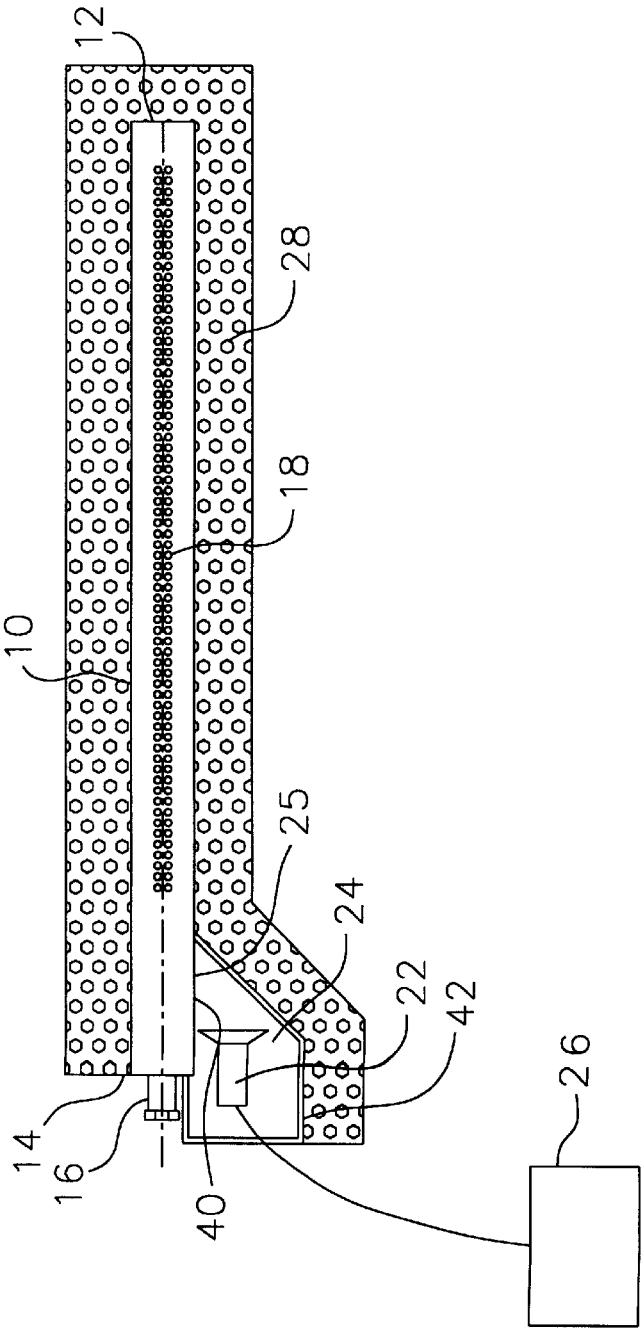
FIG. 3A depicts a burner system of the present invention including a longitudinal partial cross-sectional view of a burner tube having multiple ports which allow for the exit of the gas/air mixture.
Figure 4B:
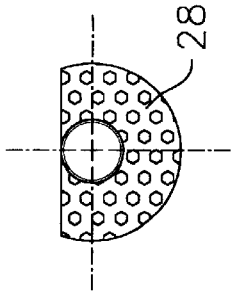
FIG. 4B is a transverse cross-sectional view of the burner tube shown in FIG. 4A.
Figure 4A:
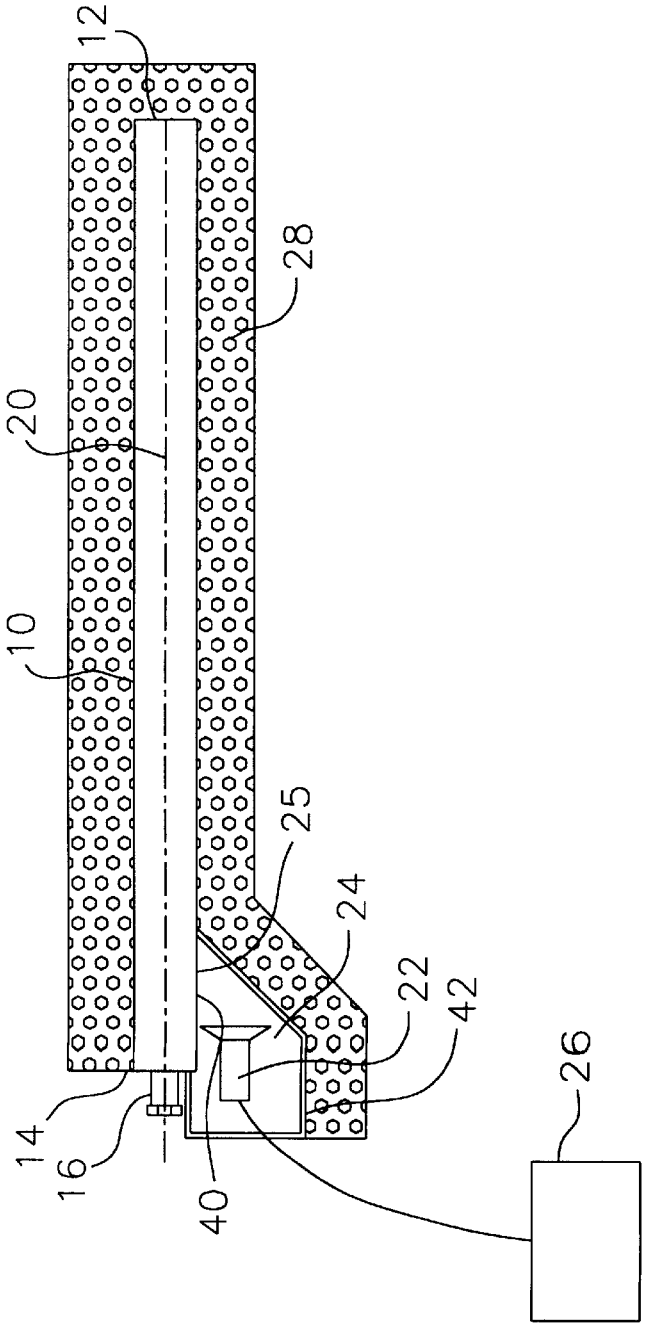
FIG. 4A depicts a burner system of the present invention including a longitudinal partial cross-sectional view of a burner tube having a slit which allows for the exit of the gas/air mixture.
Figure 5:
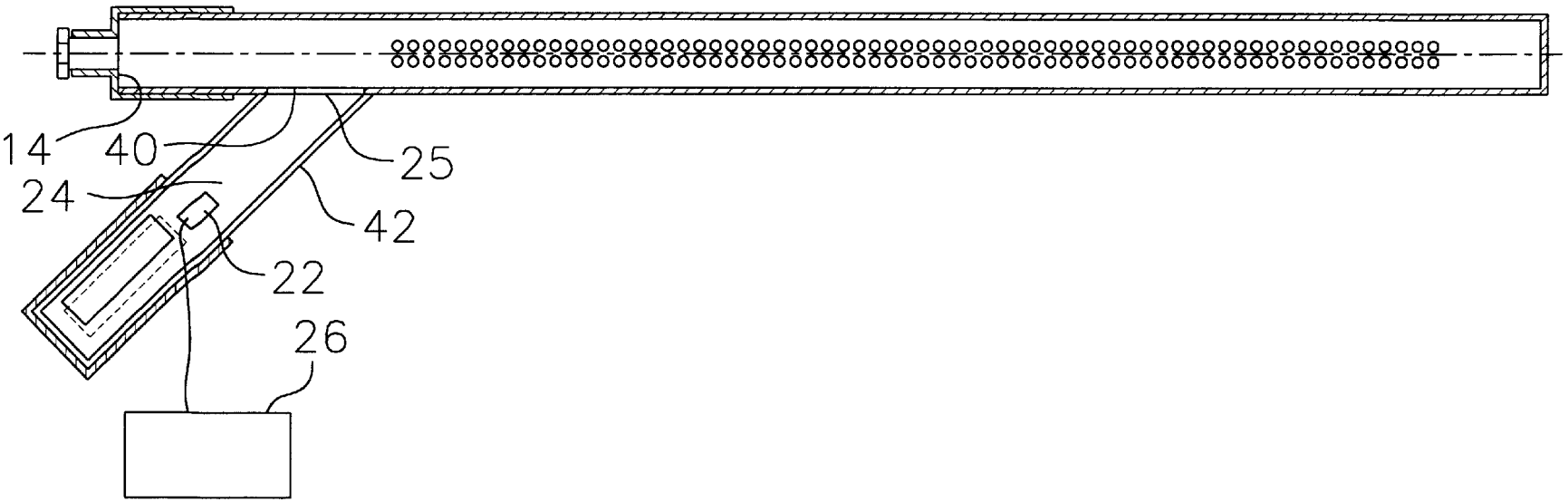
FIG. 5 is a partial cross-sectional view of a burner used with the present invention.

Various types of burners with various geometries can be used in accordance with the present invention. Preferably, however, a tubular burner 10 is used (FIGS. 3A, 4A, and 5). A tubular gas burner is very common geometry in the gas fireplace and stove industry and is easy to manufacture. A typical burner tube has an one inch outside diameter.

In a cavity having a cylindrical, tubular configuration, it is possible to achieve standing waves along the x, y and z-axes, that is, in all three directions. It is preferred that standing waves be created in one direction. However, the system may be functional with standing waves in two or three directions.

In order to ensure that the created pressure waves will be reflected, both ends 12, 14 of the burner tube must planar (or blunt) and preferably perpendicular to the side walls of the burner tube (FIGS. 3A, 4A, and 5). Typically, an orifice fitting 16 is attached to the end 14 of the burner tube for supplying gas to the burner tube. In a burner tube designed for implementing standing waves, the end 14 of the burner accommodating the orifice fitting has a smaller inlet hole than conventional burners. Moreover, the orifice fitting fits snugly through the inlet hole and does not protrude into burner tube. In this regard, the end of the burner tube remains flush. In conventional burners, the fitting is loosely fitted in the inlet hole.

A transducer, such as a speaker 22, driven by an electronic controller 26 (FIGS. 3A, 4A, and 5) can be used to produce the desired standing waves within the burner. In conventional burner designs, it is customary to admit air into the burner tube for mixing with the gas prior to combustion. With this embodiment, the speaker 22 or transducer which generates the pressure waves is positioned in the air path 24 to the burner tube. While other types of transducers may be used, for illustrative purposes, the present invention is described in conjunction with a speaker. The speaker perturbs the air stream in such a way as to create pressure waves inside the burner tube. The speaker transforms electrical signals into mechanical vibrations which cause pressure variations in the air surrounding it.

It is preferable to permit the air to enter the burner along the side 25 of the tube, as shown in FIGS. 3A, 4A, and 5 and not from an end of the burner tube. In this regard, the geometries of the burner tube ends, which are critical for ensuring that the created waves will be reflected, are not altered.

An opening 40 is formed on the side of the burner tube. The opening is formed near the gas inlet end of the burner. An air conduit 42 is then used to guide the air to the opening 40. Various types of conduits 42 may be used. For example the conduit can extend from the opening 42 at an angle and then extend parallel to the burner in a direction toward the gas inlet end of the burner, as shown in FIGS. 3A and 4A. In another embodiment, the conduit is a tube that extends at an angle to the burner from the opening 40 and backward in a direction toward the gas inlet end of the burner, as shown in FIG. 5. The length of this tube is preferably 5 inches. The speaker is preferably housed in the air conduit. Thermal considerations may effect the exact speaker location.

The lowest frequency (cycles per second or Hertz) associated with a standing wave that can exist within the burner tube is the fundamental frequency of the burner tube. This frequency has a wavelength associated with it. The end-to-end length of the burner tube will be equal to the wavelength of the fundamental frequency. Thus, long tubes would be associated with lower frequencies, while shorter tubes would be associated with higher fundamental frequencies.

To minimize acoustic noise, the burner fundamental frequency should be as high as possible. Ideally, this fundamental frequency should be above the audible range. Noise from higher frequencies may be minimized by noise absorption materials which are designed to dissipate the acoustical energy. This notion and others from Noise Control technology (e.g., barriers and noise transmission from radiating panels) are important to creating a quiet, attractive gas appliance.

The speed of sound increases in proportion with the square root of absolute temperature. In simple terms, sound waves travel faster in hotter gases. This is evidenced in the Table I below.

| AIR TEMPERATURE | SPEED OF SOUND (feet/second) |
|---|---|
| 70° F. | 1128 |
| 1500° F. | 2170 |
| 2000° F. | 2431 |

This relationship between the speed of sound and temperature also effects the fundamental frequency of the burner tube system. For any given length of burner tube, a higher fundamental frequency may be achieved in the tube in a high temperature environment. To ensure that the fundamental frequency is kept high, the burner tube is insulated with an insulation material 28 as shown in FIGS. 3A, 3B, 4A and 4B. The insulation minimizes heat loss. It may be possible to raise the fundamental frequency high enough so as to be outside the audible range of human beings by keeping the burner tube at a sufficiently elevated temperature. The audible frequency range is from about 50 Hz to 10,000 Hz. Another way to increase the fundamental frequency is to shorten the length of the burner tube. A preferred tube length as measured from the inner surface of one end of the tube to the inner surface of the second tube end is 18 inches.

In attempting to create realistic wood burning flame patterns, it is customary in conventional burner tubes to vary the pattern, size and geometry of the ports along the length of the tube. In some cases, the number of ports per square inch is different from one region to the next. In other cases, it is the port diameter which changes from one location to the next. In still other designs it is both which vary down the length of the tube.

With the present invention, however, since the geometry and size of the ports is not critical to obtaining realistic looking flame patterns, the burner tube may have a uniform number of ports 18 per square inch down the entire length of the burner. There may be a single row of ports, or multiple rows of ports. In either case, the number of ports per inch, or per square inch may be constant from one end of the burner tube to the other. Moreover, all ports may have the same diameter. A typical diameter may be in the range of 1/32 to 3/32 inch. In this regard, the burner tubes are easier to manufacture thus reducing manufacturing costs.

Alternatively, instead of ports a narrow slit 20 may be formed on the burner tube as shown in FIG. 4A. As a practical matter, this slit may have a width of 1/64 inch to 1/16 inch and would run the length of the tube.

At the crux of the present invention is the mathematical description of the standing wave inside a tube. After much effort, applicants have determined that the standing wave equation for a gas is:

$$\frac{\partial^2 W}{\partial x^2} = \frac{1}{c^2}\frac{\partial^2 W}{\partial t^2} \tag{1}$$

where

W is the displacement of an incremental element of gas.

x is the position along the x-axis.

t is time.

c is the speed of sound for a given gas.

This equation defines a Boundary Value problem whose solution is, in general, given in the form of a Fourier Series. Typically the solution is comprised of the elements shown below:

$$F(t) = A_0 + \sum_{n=1}^{\infty} A_n \cos\frac{2\pi nt}{T_0} + \sum_{n=1}^{\infty} B_n \sin\frac{2\pi nt}{T_0} \tag{2}$$

Standing Waves are created by the interference of an incident wave with a reflected wave. The incident pressure wave is the wave that is emitted by a noise source at one end of the burner. The reflected wave is, as the name suggests, the return of the incident wave after it hits the wall at the far end of the burner tube. The pressure distribution along the burner length corresponds to the amplitude variation of the standing pressure wave inside the burner.

Figure 6:
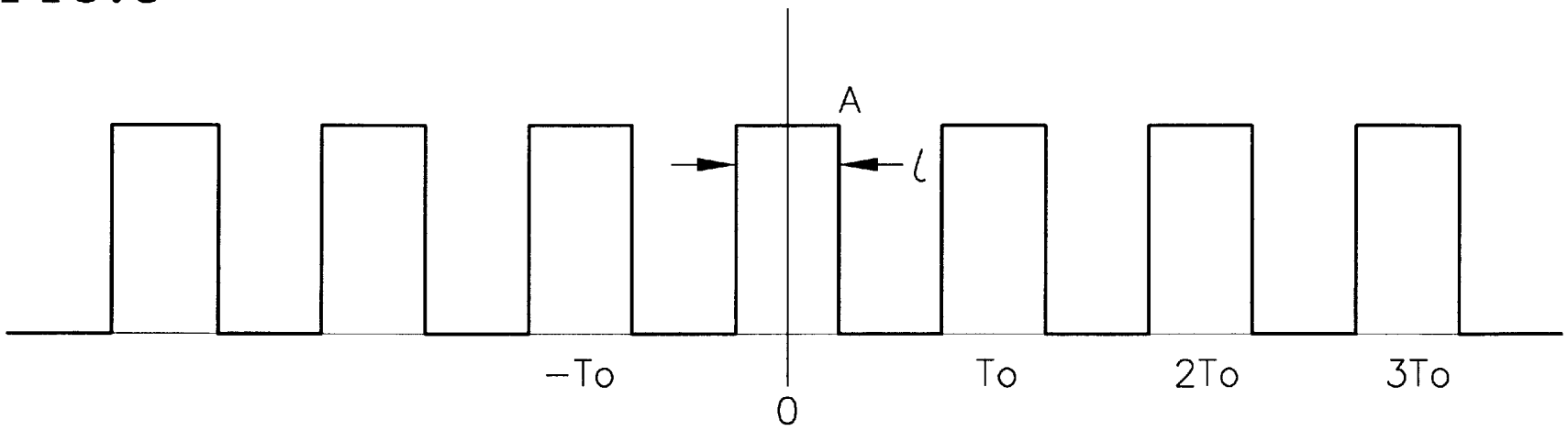
FIG. 6 depicts a square wave.

Any particular pressure wave can be represented in a Fourier Series. A Fourier Series allows a periodic function of time having a fundamental period $T_0$ to be represented as an infinite sum of sinusoidal waveforms. For example, a periodic train of square waves or pulses, as shown in FIG. 6, can be created by the summation of sinusoids having the appropriate frequencies, each of which has a specific, non-arbitrary amplitude. This means that when a square wave or pulse train is being produced also being created are an infinite set of Fourier sines and cosines.

Hence, each standing pressure wave can be represented as a series of Fourier sines and cosines having discrete frequencies and amplitudes. These sines and cosines may determined by the following Fourier Series equations.

$$F(t) = A_0 + \sum_{n=1}^{\infty} A_n \cos\frac{2\pi nt}{T_0} + \sum_{n=1}^{\infty} B_n \sin\frac{2\pi nt}{T_0} \tag{3}$$

The constant $A_0$ is the average value of F(t):

$$A_0 = \frac{1}{T_0}\int_{-\frac{T_0}{2}}^{\frac{T_0}{2}} F(t)\,dt \tag{4}$$

and the coefficients $A_n$ and $B_n$ are given by $$A_n = \frac{2}{T_0}\int_{-\frac{T_0}{2}}^{\frac{T_0}{2}} F(t)\cos\frac{2\pi nt}{T_0}\,dt \tag{5}$$

and $$B_n = \frac{2}{T_0}\int_{-\frac{T_0}{2}}^{\frac{T_0}{2}} F(t)\sin\frac{2\pi nt}{T_0}\,dt \tag{6}$$

Thus, the Fourier sine and cosine sets can be determined for each given pressure distribution (i.e., standing wave) along the burner tube. Once, the Fourier sine and cosine sets are known, the electronic controller 26 driving the speaker 22 can be programmed to drive the speaker to produce the requisite Fourier sine and cosine pressure waves required to generate the desired standing pressure waves (and pressure distributions) inside the burner tube. As a result, the speaker can generate an infinite number of pressure distributions within the burner tube. The controller can be programmed, or a computer may drive the controller, to cause the speaker to produce a different set of Fourier sine and cosine waves, even at time increments of less than a second, thereby resulting in different pressure distributions within the burner tube. Consequently, dynamic flame patterns are created that can change in time increments of less than a second simulating a realistic wood burning flame. The controller may also be programmed to cause the generation of different standing waves at constant or random time intervals.

In an alternate embodiment, the flame patterns are varied to simulate a realistic wood burning flame by varying the simple harmonic motion of the gas/air flow in the burner resulting in varying pressure waves generated in the burner.

Harmonic motion is a fundamental notion in science because it appears so frequently in the physical universe. Harmonic motion is described by sinusoidal and cosinusoidal functions. A typical harmonic motion is as follows:

$$y(t)=A^* \text{ SIN } (2\pi ft) \tag{7}$$

where y(t)=position along the y-axis as a function of time

A=a coefficient representing the maximum Amplitude of oscillation and f=the frequency of oscillation, in Hertz This simple function describes numerous reciprocating processes in nature and the real world. In addition, it describes the motion of fluid particles, such as air, as sound is conveyed between two distant points.

When two sinusoids of the same frequency, with different phase angles are summed, the result is a sinusoid with nearly the same frequency as the original two. The amplitude however, is no longer a constant, it is a sinusoidal function of time having the phase angle $\alpha$ as described by the following three equations.

$$x=X\cos(\omega t)+X\cos(\omega+\alpha)t \tag{8}$$

where $\alpha$ is very, very small, with respect to $\omega$ $$x=X\{\cos(\omega t)+\cos(\omega+\alpha)t\} \tag{9}$$

$$x=[2X\cos(\alpha/2)t]^* \cos(\omega+\alpha/2)t \tag{10}$$

The result is a sinusoid whose frequency is essentially $\omega$, since $\alpha/2 \ll \omega$ and $(\omega+\alpha/2)t \approx \omega$). Another result is that the amplitude of this cosine function which is usually considered to be constant, is now a cosine function of $(\alpha/2)t$. As such, the amplitude of the function varies with time, at the low frequency of $f=\alpha/4\pi$ (because $\omega t=\alpha t/2$ and $2\pi f=\alpha/2$). This low frequency is said to throb or beat when heard, hence named beat frequency.

Figure 7:
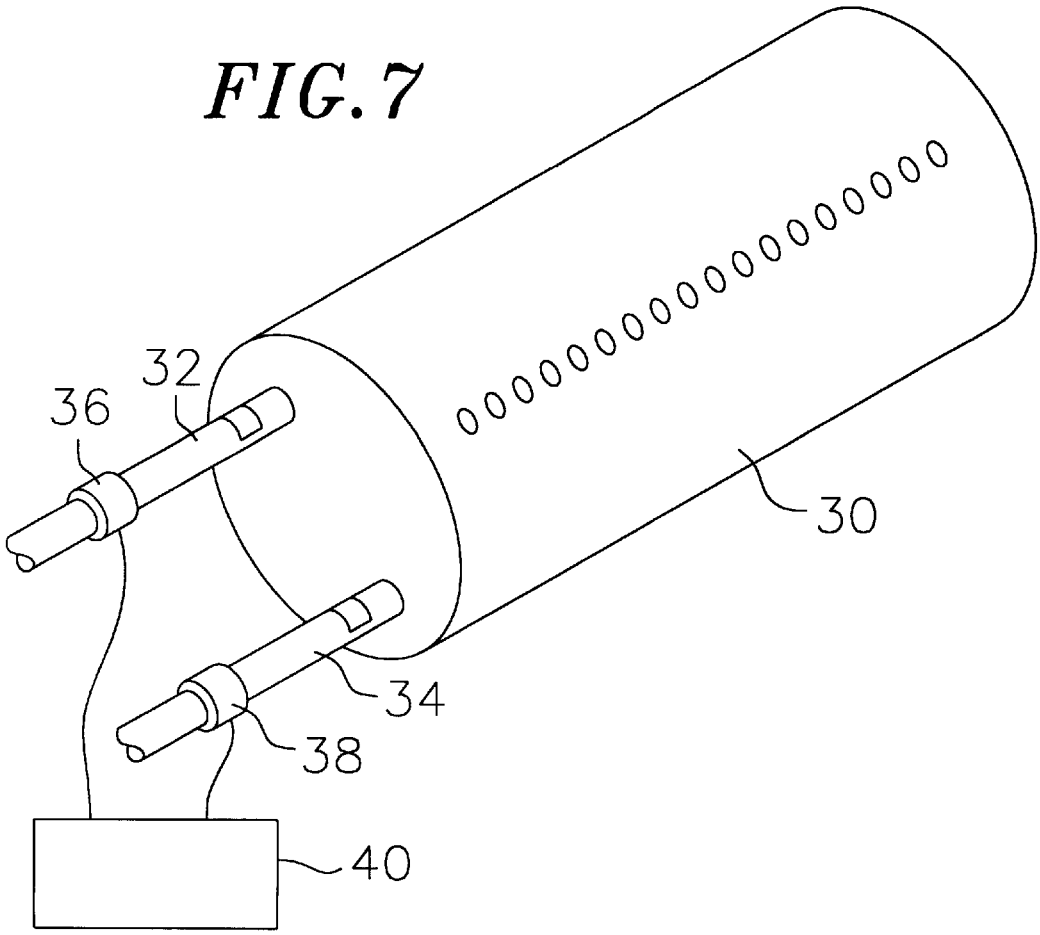
FIG. 7 depicts a burner system of the present invention including a perspective view of a burner having two gas flows.

With this embodiment, a burner 30 having two gas flow inlets 32, 34 as shown in FIG. 7, is used. The burner can be of any type as for example a tubular or a pan burner. A separate simple electromechanical valve 36, 38 each driven by a sinusoidal electric signal, controls the gas flow to each burner input. One valve 36 opens and closes to meter the gas flow volume according to the function $\cos(\omega t)$ . The other valve opens and closes to meter the gas flow volume according to the function $\cos(\omega+\alpha)t$. Consequently, a pressure wave described by equation (10) is generated within the burner. The sinusoidal signals which drive (i.e., control) the valves are generated by a controller 40 which can vary $\alpha$. Separate controllers can also be used to control each valve.

Alternatively, instead of being metered according to sinusoidal functions, the two gas flows can be metered according to other orthogonal functions. The two flows should be offset by a phase angle.

As discussed above, a beat frequency results in addition to the primary frequency, $\omega$. The rate of occurrence of the beat defining the beat frequency can be controlled electronically by varying $\alpha$. As $\alpha$ goes to zero, the beat frequency becomes lower and lower, with more and more time between pressure fluctuations inside the burner. When $\alpha$ becomes larger, the beat frequency increases until it is no longer perceptible. Thus, by varying $\alpha$, the pressure waves generated inside the burner are changed. Each gas/air pressure wave generated inside the burner creates a sinusoidal pressure distribution inside the burner. By changing the pressure waves, the pressure distribution inside the burner is changed. Consequently, the heights of the flames are changed and are also varied along the burner length as different pressure waves are generated inside the burner. Hence, by changing the pressure waves generated in the burner, the burner produces changing flame patterns which simulate realistic wood burning flame patterns.

What is claimed is:

1. A gas burner system for producing dynamic flame patterns comprising:

a burner having a first end and a second end and a body therebetween;

an inlet port for the inlet of gas;

a gas outlet;

a gas flow within the body;

a standing wave within the gas flow; and a transducer coupled to the burner for producing an output for generating the standing wave within the body.

2. A gas burner system as recited in claim 1 further comprising a controller for controlling the output of the transducer.

3. A gas burner system as recited in claim 1 wherein the gas outlet comprises a plurality of outlet ports formed on the burner body.

4. A gas burner system as recited in claim 1 wherein the gas outlet comprises a slit formed along the burner body.

5. A gas burner system as recited in claim 1 further comprising an air inlet opening formed on the burner, wherein the transducer is in communication with the air inlet opening.

6. A gas burner system as recited in claim 5 wherein the air inlet opening is formed on a side surface of the burner near the first end of the burner and wherein the inlet port is formed on the first end of the burner.

7. A gas burner system as recited in claim 5 wherein the transducer is a speaker.

8. A gas burner system as recited in claim 5 further comprising an air conduit housing the transducer and extending from the air inlet opening.

9. A gas burner system as recited in claim 1 wherein the first end has a blunt inner surface and wherein the second end has a blunt inner surface.

10. A gas burner system as recited in claim 1 further comprising an insulating material surrounding at least a portion of the burner.

11. A gas burner system for producing dynamic flame patterns comprising:

a burner having a first end having a blunt inner surface and a second end having a blunt inner surface and a body therebetween;

an inlet port for the inlet of gas, the inlet port formed on the first end;

an outlet port;

an air inlet opening formed on the body near the first end;

a conduit extending from the air inlet opening;

a transducer in the conduit for producing mechanical impulses in response to electrical signals for generating a standing wave within the body; and a controller producing the electrical signals.

12. A gas burner system as recited in claim 11 wherein the transducer is a speaker.

13. A gas burner system as recited in claim 11 further comprising an insulating material surrounding at least a portion of the burner.

14. A method for producing a desired flame pattern from a gas burner having a gas inlet and a gas outlet, the method comprising the steps of:

supplying gas to the burner;

supplying air to the burner creating a gas and air mixture flow within the burner;

generating a standing wave in the flow; and igniting the gas and air mixture exiting through the gas outlet.

15. A method as recited in claim 14 wherein the gas outlet comprises a plurality of outlet ports formed along the burner.

16. A method as recited in claim 14 wherein the gas outlet comprises a slit formed along the burner.

17. A method as recited in claim 14 further comprising the step of varying the frequency of the standing wave.

18. A method as recited in claim 14 further comprising the step of varying the amplitude of the standing wave.

19. A method as recited in claim 14 wherein the step of generating a standing wave comprises the step of varying the pressure of the gas and air flow mixture along the burner.

20. A method as recited in claim 14 further comprising the step of generating a new standing pressure wave in the flow.

21. A method as recited in claim 14 wherein the burner has a length dimension, a width dimension and a height dimension, wherein the method comprises the step of generating a standing wave along at least two dimensions.

22. A method as recited in claim 14 wherein the burner has a fundamental frequency, the method further comprising the step of increasing the burner fundamental frequency.

23. A method as recited in claim 22 wherein the step of increasing the fundamental frequency of the burner comprises the step of reducing heat losses from the burner.

24. A method as recited in claim 14 further comprising the step of surrounding at least a portion of the burner with an insulating material.

25. A method as recited in claim 14 wherein the step of generating a standing wave comprises the step of transmitting acoustic waves to the burner.

26. A method for producing a desired flame pattern from a gas burner having a gas inlet and a gas outlet, the method comprising the steps of:

supplying gas to the burner;

supplying air to the burner creating a gas and air mixture flow within the burner;

generating a sinusoidal standing pressure variation in the flow along the burner; and igniting the gas and air mixture exiting through the gas outlet.

* * * * *